United States Patent [19]

Gerbet et al.

[11] 4,201,381

[45] May 6, 1980

[54] RACQUET FRAMES

[75] Inventors: Roger G. Gerbet, Etampes; Jean-Claude Leroux, Saclas; Daniel L. Morin, Evry; Marius F. Leclercq, Lagny, all of France

[73] Assignee: Societe Nationale des Poudres et Explosifs, Paris, France

[21] Appl. No.: 885,623

[22] Filed: Mar. 13, 1978

[30] Foreign Application Priority Data

Mar. 18, 1977 [FR] France ..... 77 08234

[51] Int. Cl.[2] ..... A63B 49/10

[52] U.S. Cl. ..... 273/73 F

[58] Field of Search ..... 273/73 C, 73 F, DIG. 7, 273/DIG. 23; 280/610

[56] References Cited

U.S. PATENT DOCUMENTS

| | | | |
|---|---|---|---|
| 2,626,804 | 1/1953 | Robinson | 273/73 F |
| 3,369,821 | 2/1968 | Weber | 280/610 |
| 3,540,728 | 11/1970 | Palmer | 273/73 H |
| 4,070,019 | 1/1978 | Segal et al. | 273/73 F |
| 4,098,505 | 7/1978 | Thompson | 273/73 F |

FOREIGN PATENT DOCUMENTS

| | | | |
|---|---|---|---|
| 17462 | 5/1934 | Australia | 273/73 F |
| 1958349 | 5/1971 | Fed. Rep. of Germany | 280/610 |
| 585489 | 2/1947 | United Kingdom | 273/DIG. 7 |
| 1436755 | 5/1976 | United Kingdom | 273/73 F |

*Primary Examiner*—Richard J. Apley

*Attorney, Agent, or Firm*—Bucknam and Archer

[57] ABSTRACT

The present invention relates to racquet frames.

The racquet frame according to the invention comprises thin strips which are glued to one another; the length of at least one strip corresponds to a complete loop of the frame; the width of the strips corresponds to the thickness of the frame in the direction perpendicular to the plane of the frame, and the thickness of the strips corresponds to a fraction of the thickness of the frame in the plane of the frame. The cross-section of the frame preferably possesses at least one recess, and each strip contains of high-performance fibres which are oriented longitudinally.

7 Claims, 19 Drawing Figures

RACQUET FRAMES

The present invention relates to frames for racquets which are intended to be used for tennis or similar games.

It has already been proposed to produce racquet frames from synthetic resin by moulding. Taking into account the characteristics which such frames must possess, this requires the use of particular techniques. In particular, it has been envisaged to manufacture racquet frames in the form of a solid unit which is injection-moulded from synthetic resin. However, such a frame is too heavy and performs poorly. Furthermore, a frame comprising a hollow moulded unit requires a process which is rather unsuitable for economic manufacture in industry.

The present invention relates to a frame, the particular structure of which makes it possible to manufacture the frame by a simple and cheap process and to nevertheless obtain a frame which conforms to the criteria with which it should comply.

The frame according to the invention comprises thin strips which are manufactured separately and glued or bonded to one another. The length of at least one strip corresponds to a complete loop of the frame, its width corresponds to the thickness of the frame in the direction perpendicular to the plane of the frame, and its thickness corresponds to a fraction of the thickness of the frame in the plane of the frame. Each strip possesses at least one longitudinal recess, which reduces its thickness without altering its width, which retains a sufficient surface area on each face of the strip to enable the strip to be glued or bonded satisfactorily to the adjacent strip, and which is such that, in each cross-section of the strip, the mass is distributed a long way from the centre of gravity. The strips forming the frame of the invention consist of high-performance fibres which are oriented longitudinally relative to the strip and impregnated with a resin.

However, it is possible to introduce a transverse reinforcement (fabric) in order to improve the transverse characteristics.

The fibres which can be used according to the invention are especially glass fibres, carbon fibres, boron fibres and high-performance organic fibres.

The resins used for impregnating the fibres are thermosetting resins, preferably epoxy resins or polyester resins.

In general terms, it can be said that valuable characteristics for a racquet frame are the longitudinal, transverse and torsional rigidities, the weight, the longitudinal, transverse and torsional mechanical strengths, and the fatigue resistance. The characteristics are the direct result of the specific properties of each strip, of the number of strips and of the quality of the bands between these strips. For a given strip, the rigidity characteristics vary as a function of the values of the modulus of elasticity of the material which forms the strip, and they depend on the shape of the strip, that is to say on the shape of its cross-section. For a given material, the mechanical strength is generally proportional to the amount of material.

The strips according to the invention possess the characteristics which are required for their use in the manufacture of racquet frames. These characteristics are due in particular to their shape. The cross-section of the strips fits into a rectangle.

The width of the cross-section corresponds to the thickness of the strip, that is to say to a fraction of the thickness of the frame in the plane of the frame.

The length of the cross-section corresponds to the width of the strip, that is to say to the thickness of the frame in the direction perpendicular to the plane of the frame. The cross-section of a strip possesses a recess along at least one of the lengths. This recess is situated in a central position so that the mass is distributed a long way from the centre of gravity in each cross-section. This condition is necessary in order for the frame to possess the adequate longitudinal and transverse rigidities for a given material.

Furthermore, the recess existing in the cross-section must leave a remaining portion of such a length that two strips can be solidly glued to one another by their faces corresponding to the length of the cross-section.

The dimensions of the cross-section of the strip depend on the modulus of elasticity, on the fibre used and on the minimum radius of curvature to which the strip will have to be subjected. They are determined in such a way that the residual strain is negligible.

The frame according to the invention comprises several strips joined together. Numerous variants are possible, both in the choice of the number of strips and in the choice of the material or of the shape of the cross-section.

The number of strips to be used depends especially on the thickness of each of them and on the thickness of the frame in the direction perpendicular to the plane of the frame. This latter size must be within a range which is well-known in the technical field in question. If the mechanical characteristics of the individual strips are high, it is possible either to reduce the number of strips, or to reduce the thickness of the strips, or also to combine these two possibilities It is also possible to join together strips made of different materials, provided that the surface areas, which make it possible to glue these strips together, are sufficiently large.

In general, the strips used in the manufacture of a frame according to the invention form a complete loop of the frame. However, it is possible, without going outside the field of the invention, to manufacture frames in which only part of the strips forms a complete loop and one or more strips are used only to strengthen part of the frame.

The present invention is illustrated by the attached drawings in which.

Figure 1:
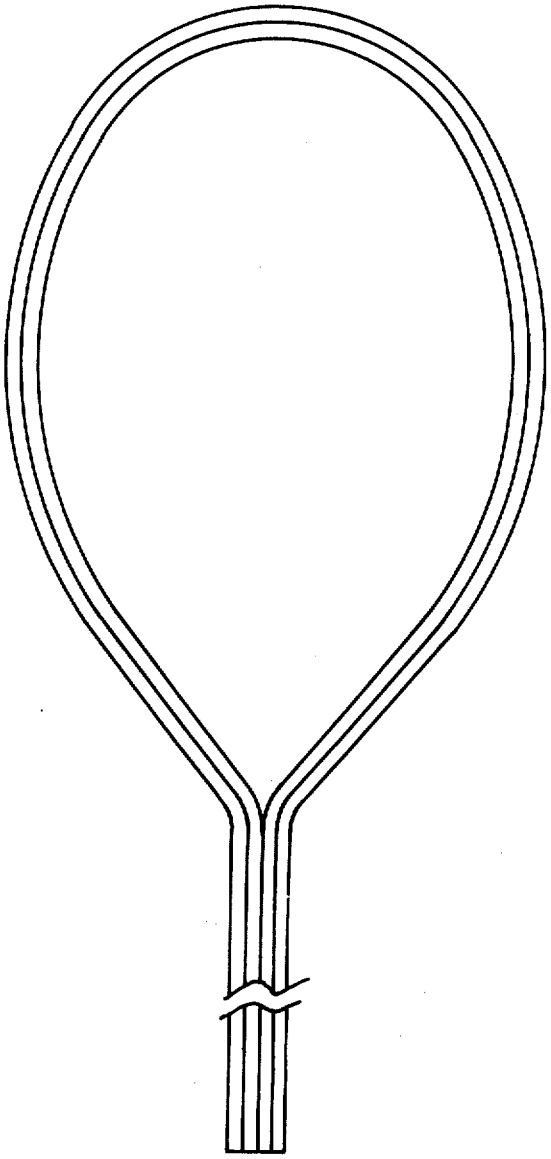
FIG. 1 shows an elevated view of a frame according to the invention.
Figure 2:
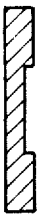
FIGS. 2 to 7 show various cross-sections of strips.

FIGS. 2 to 7 show some of the cross-sections, according to the invention, of a strip. These include a particularly valuable cross-section which is shown in FIG. 2. The cross-section possesses a rectangular recess and the dimensions conform to the following conditions. If A and B are respectively the length and width of the rectangular cross-section, and a and b are the length and width of the recess:

A corresponds to the customary thicknesses of a racquet frame, the ratio of A/B is between 5 and 25, and preferably equal to 10, the ratio a/A is equal to about 1/2, and the ratio b/B is equal to about 5/12.

Figure 3:
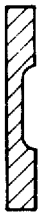
Figure 4:
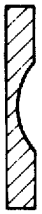
Figure 5:
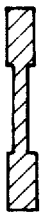
Figure 6:
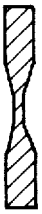
Figure 7:
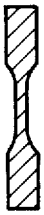
Figure 8:
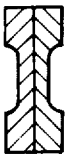
FIGS. 8 to 19 show various cross-sections of a frame.
Figure 9:
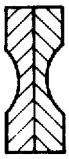
Figure 10:
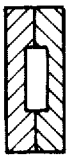
Figure 11:
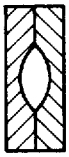

The preferred cross-section for a strip according to the invention is shown in FIG. 3. This cross-section differs from that of FIG. 2 in that the internal angles of the recess are rounded. Such a shape decreases the discontinuity of the rigidity at the level of these angles and thus reduces the likelihood of breakage at this level during the shaping of the strips in the mould on the one hand, and during the use of the racquet on the other hand.

The racquet frames according to the invention are manufactured by a simple process consisting in manufacturing, by pultrusion, a profile which is made of high-performance fibres impregnated with resin and which has the desired cross-section, the fibres being orientated longitudinally relative to the profile which can optionally contain a transverse reinforcement such as, for example, a fabric, in cutting the profile into strips of a sufficient length, in joining together the required number of strips in a metallic mould having the shape of the frame, in placing a layer of adhesive between the strips, it being possible to add a transverse reinforcement, such as a fabric, a mat or the like, during this operation, and in subjecting the whole to a baking operation.

The following examples describe the production of a few particular frames according to the present invention.

EXAMPLE 1

A profile of glass fibre impregnated with an epoxy resin is manufactured by pultrusion, this profile having a cross-section such as that shown in FIG. 3, in which FIG. A, B, a and b, defined above, have the following values:

$A_1 = 19$ mm
$B_1 = 1.7$ mm
$a_1 = 7$ mm
$b_1 = 0.7$ mm

Figure 12:
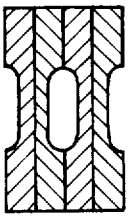

The profile is cut into strips having a length which corresponds to a complete loop of the frame, and, after a layer of adhesive has been placed between these strips, they are joined together in a mould so as to obtain a cross-section of the frame such as the cross-section shown in FIG. 12, and the whole is subjected to an after-baking operation.

EXAMPLE 2

A profile of carbon fibre impregnated with an epoxy resin is manufactured by pultrusion, this profile having the following dimensions:

$A_2 = 19$ mm
$B_2 = 1.1$ mm
$a_2 = 9$ mm
$b_2 = 0.4$ mm

Figure 13:
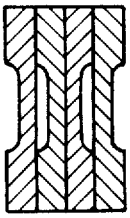
Figure 14:
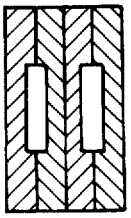
Figure 15:
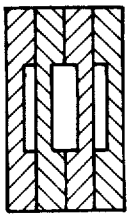
Figure 16:
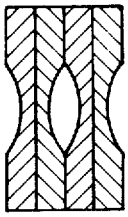
Figure 17:
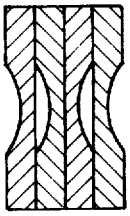
Figure 18:
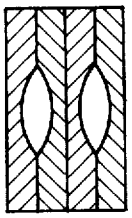
Figure 19:
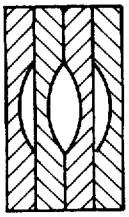

The frame is produced by joining together two strips of profile according to the present example and two strips according to Example 1, the four strips forming a complete loop of the frame. The cross-section of the frame is such as that shown in FIG. 13, the two central strips consisting of carbon fibre and the two outer strips consisting of glass fibre.

In this example, the four strips forming the frame together show an increase in weight of 20% relative to the frame of Example 1, for an improved rigidity.

The frame according to the invention will of course be equipped with the usual accessories, especially a throat-piece, parts which strengthen the handle, strings and the like.

From the frame transverse cross-sections shown by FIGS. 8 through 19, it can be noted that the strips are arranged with their recesses disposed to give in each case, a frame transverse cross-section that is symmetrical about a center line. As will be appreciated by the artisan, such symmetry in cross-section makes it simpler to control the strength and elasticity characteristics of the frame.

We claim:

1. Racquet frame consisting of four generally similar laminar strips, the transverse cross-section of each of said strips being bounded by a rectangle, said strips being bonded to one another, the length of each strip corresponding to a complete loop of the frame, the width of the strips corresponding to the thickness of the frame in the direction perpendicular to the plane of the frame, the thickness of each strip corresponding to a fraction of the thickness of the frame in the plane of the frame, each strip having a single longitudinal groove which reduces the thickness of the strip thereat, and which maintains on each face of the strip a surface sufficient to permit a given bonding with the adjoining strip, and which is such that, in each cross-section of the strip, the mass is distributed remotely from the center of gravity, and in each strip there are reinforcing fibres which are impregnated with a thermosetting resin and are oriented longitudinally relative to the strip, further characterized in that the two outer strips of the frame are each positioned that the concavity of the respective longitudinal groove faces outwardly, and that the two inner strips are positioned in such a manner that the transverse cross-section of the frame is symmetrical with respect to a central line perpendicular to the plane of the frame.

2. Racquet frame according to claim 1 wherein said longitudinal groove is generally rectangular in transverse cross-section.

3. Racquet frame according to claim 2 wherein said longitudinal groove has rounded internal corners.

4. Frame according to claim 1, wherein the fibres are glass fibres.

5. Frame according to claim 1, wherein the fibres are carbon fibres.

6. Frame according to claim 1, wherein the fibres are organic fibres.

7. Frame according to claim 1, wherein the fibres are boron fibres.

* * * * *